United States Patent [19]

Bueno et al.

[11] Patent Number: 4,726,297

[45] Date of Patent: Feb. 23, 1988

[54] SUBMUNITION EJECTION SYSTEM

[76] Inventors: Leoncio M. Bueno, c/ Madre Vedruna no 1, 50008, Zaragoza; Rafael G. Pérez, C/ Caleruega, 13, Pinar De Chamartin, Madrid, both of Spain

[21] Appl. No.: 865,837

[22] Filed: May 22, 1986

[30] Foreign Application Priority Data

May 22, 1985 [ES] Spain ..... 543402

[51] Int. Cl.[4] ..... F42B 13/50

[52] U.S. Cl. ..... 102/489; 102/357; 102/506

[58] Field of Search ..... 102/340, 342, 351, 357, 102/489, 505, 506

[56] References Cited

U.S. PATENT DOCUMENTS

| | | | |
|---|---|---|---|
| 1,017,928 | 2/1912 | Tocik | 102/506 |
| 3,712,229 | 1/1973 | Schock | 102/489 |
| 4,488,489 | 12/1984 | Schoffe | 102/489 |

FOREIGN PATENT DOCUMENTS

| | | | |
|---|---|---|---|
| 3048618 | 7/1982 | Fed. Rep. of Germany | 102/489 |

*Primary Examiner*—Harold J. Tudor

*Attorney, Agent, or Firm*—Mason, Fenwick & Lawrence

[57] ABSTRACT

A projectile has a housing with a forward end a rearward portion. A pusher disc in the rear portion of the housing supports columns of submunitions which are urged forwardly by a forward force exerting compression spring toward bell means mounted in the forward end of the housing. A plurality of rods each have a shear portion adjacent their lower ends and a forward end connected to the bell and a lower end fixed connected to the rear end of the projectile. The forward force exerting spring urges submunitions forwardly against a front plate which is prevented from forward movement by engagement with the bell. Explosive means shear the rods and separate the forward portion of the housing from the tail portion and outward force exerting springs shift the forwardmost submunition outwardly after separation of the forward housing portion from the tail portion so that the forward force exerting spring moves the remaining submunitions forwardly for subsequent discharge from the projectile.

2 Claims, 16 Drawing Figures

SUBMUNITION EJECTION SYSTEM

BACKGROUND OF THE INVENTION

The present application involves a military projectile including submunitions (individual explosive charges) contained in a head or carrier vector, which may be an artillery projectile, rocket head, mortar shell or any other explosive device.

Several different types of projectiles are known housing submunitions in their interior and using various methods to expel or disperse the individual bombs or explosive charges. However, prior known devices have not always provided satisfactory performance in ejecting and dispersing the submunitions.

The submunition ejection system of the subject invention constitutes an original design with substantial improvements over other systems currently in use, being based on a specific and unique procedure for expelling and dispersing the submunitions carried in a mortar shell or the like, although the principle and development of the system may be equally applied to any other carrier vehicle, such as those mentioned above. Thus, its application to the mortar shell is not of a restrictive nature, but merely serves to illustrate one of its potential applications.

SUMMARY OF THE INVENTION

The principle forming the basis of the present system is the combined use of two different complementary systems: one causing the submunitions to be ejected, and the other facilitating their dispersion by the wind once they have been expelled and ejected.

The following detailed description is given with accompanying diagrams for a better understanding of the basics of the invention proposed. These illustrate the procedure considered to be most suitable and serve as an example of its applicability without restricting the scope of the invention since practical experience may suggest slight modifications without altering the spirit and scope of the invention.

DESCRIPTION OF THE PREFERRED EMBODIMENT

Figure 1:
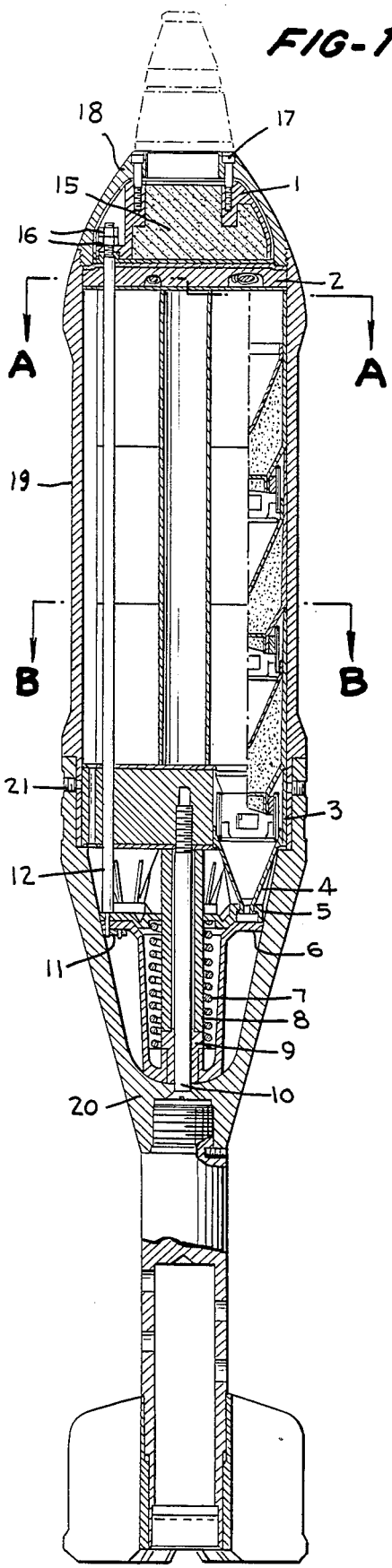
FIG. 1 is a longitudinal section of the projectile or carrier vehicle.
Figure 2:
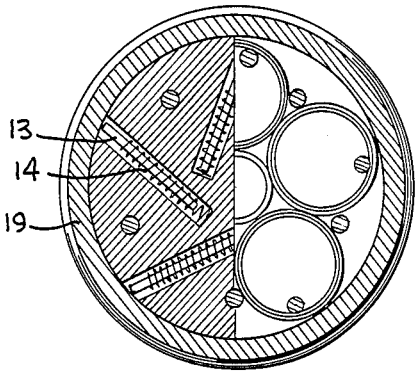
FIG. 2 a transverse section through lines A—A.
Figure 3:
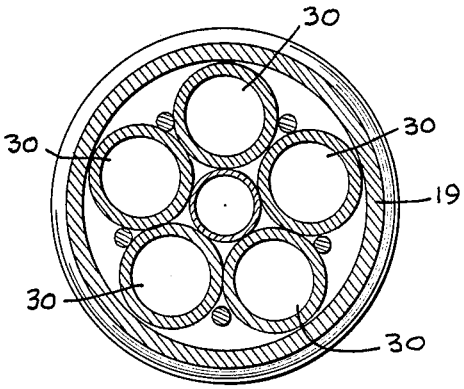
FIG. 3 is a transverse section through line B—B of FIG. 1.
Figure 4A:
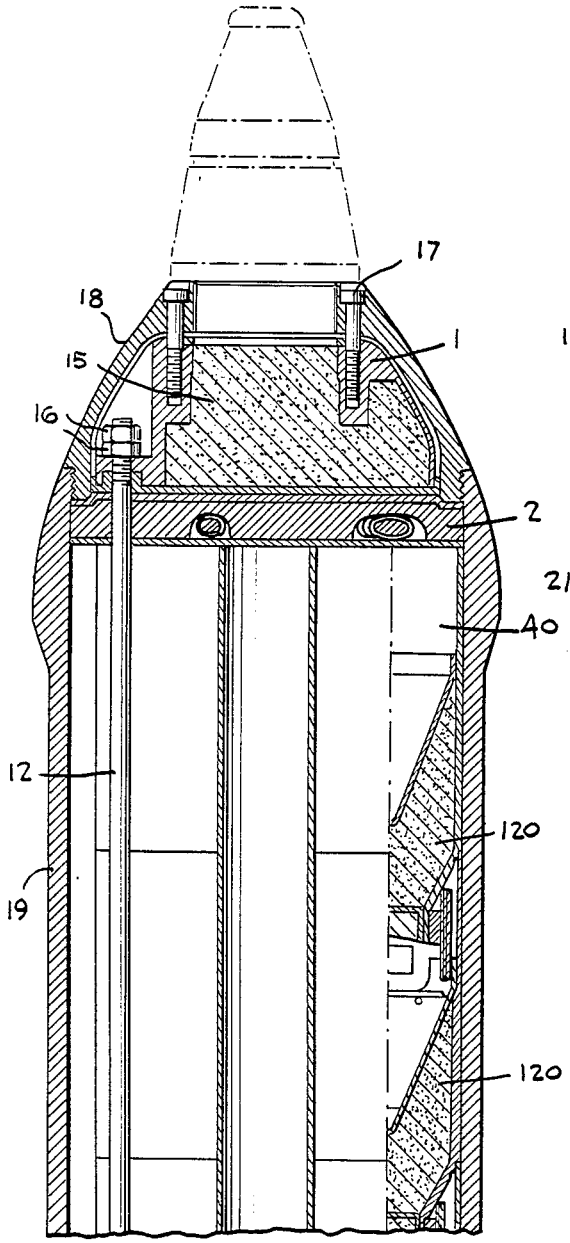
FIG. 4A is an enlarged sectional portion of the forward end of the projectile.
Figure 4B:
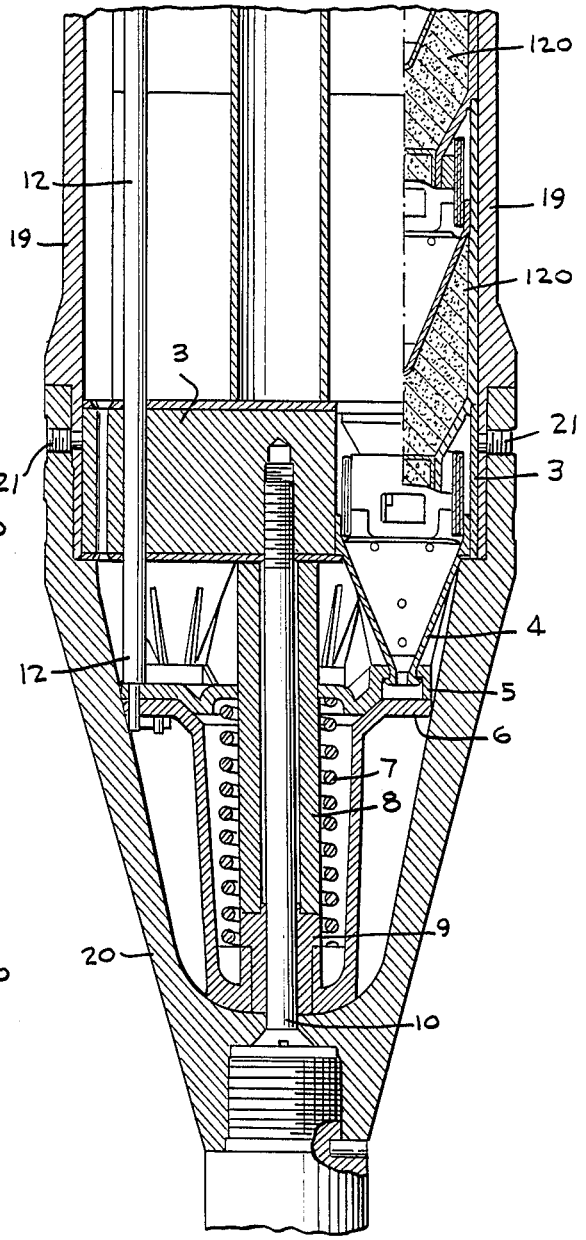
FIG. 4B is an enlarged sectional portion of a central part of the projectile.
Figure 4C:
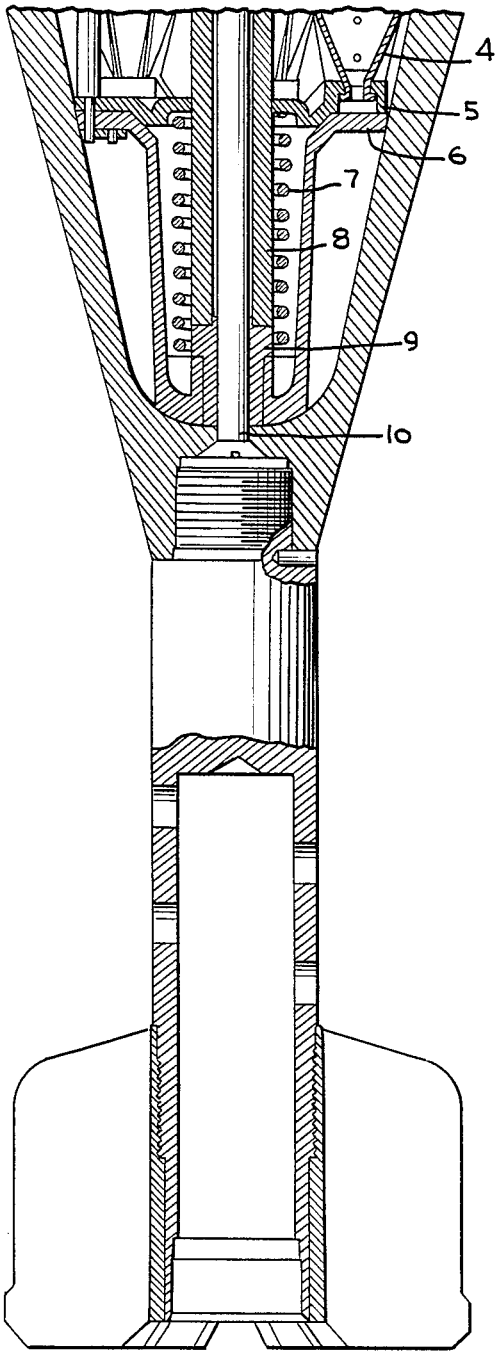
FIG. 4C is an enlarged sectional portion of the tail portion of the projectile.
Figure 5:
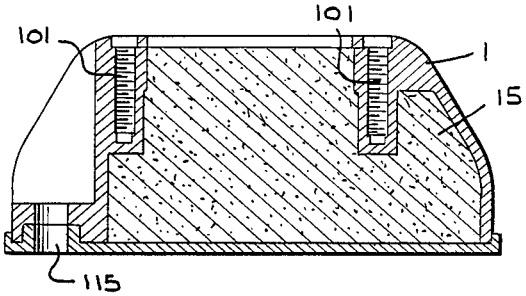
FIG. 5 is a vertical section of a housing enclosing an actuating charge employed in the preferred embodiment.
Figure 8:
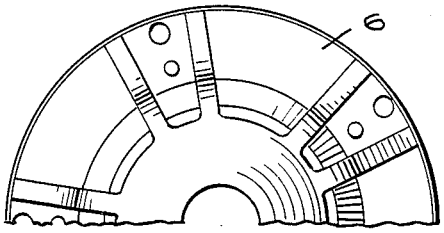
FIG. 8 is a top plan view of the spring-mounting vessel of FIG. 6.
Figure 6:
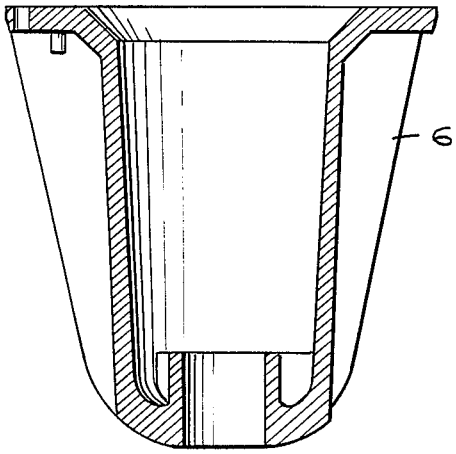
FIG. 6 is a bisecting sectional view of a spring-mounting vessel.
Figure 7:
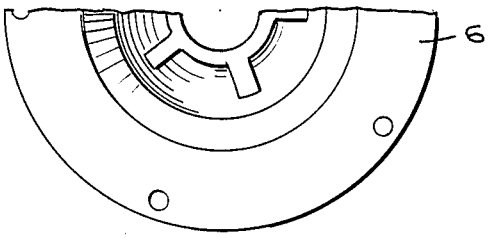
FIG. 7 is a bottom plan view of the springmounting vessel of FIG. 6.
Figure 9:
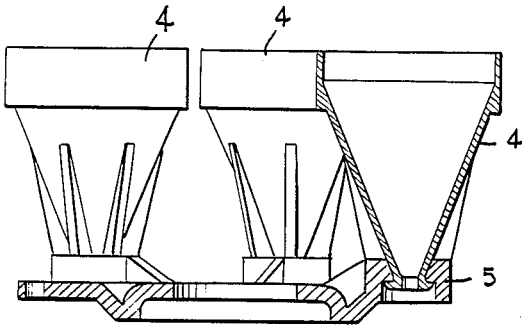
FIG. 9 is a side elevation, partially in section, illustrating a thrust cones and supporting means thereof.
Figure 13:
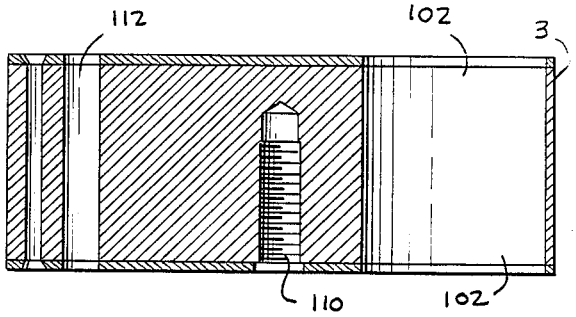
FIG. 13 is a bisecting sectional view of a sub-component of the assembly.
Figure 10:
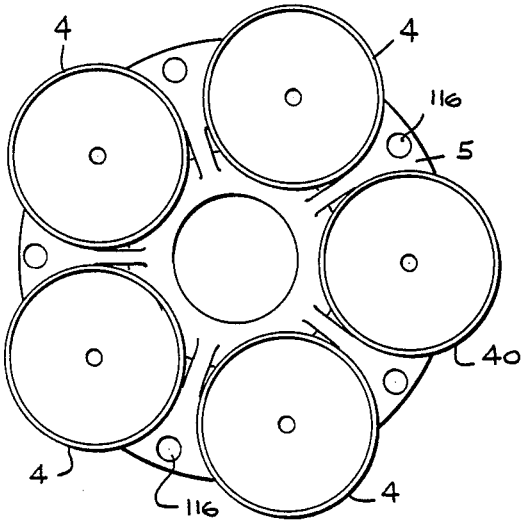
FIG. 10 is a top plan view of the thrust cone mounting arrangement of FIG. 9.
Figure 14:
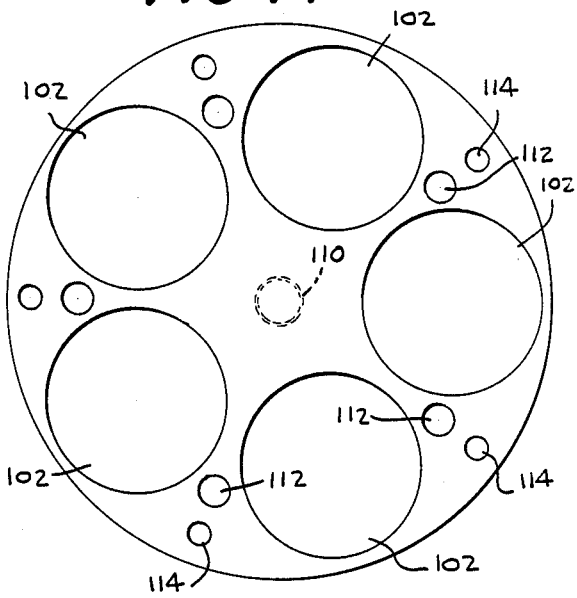
FIG. 14 is a plan view of the sub-component of FIG. 13.
Figure 11:
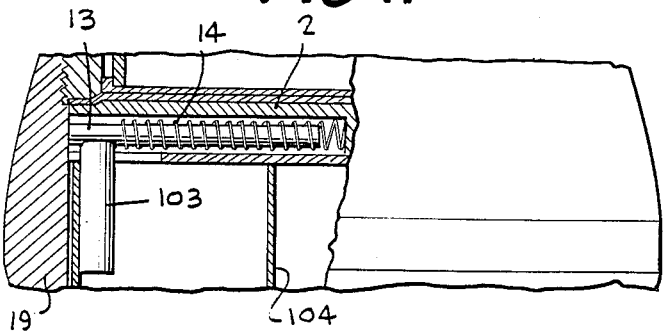
FIG. 11 is sectional view illustrating for ejecting submunitions from the projectile prior to actuation of said means.
Figure 12:
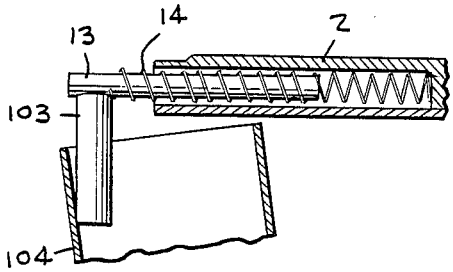
FIG. 12 is a side elevation, partially in section, of the means of FIG. 11 following initiation of its operation for ejecting a submunition.

As can be seen from the drawings, the projectile includes a housing 19 in side of which submunitions 120 composed of several stacked layers duly arranged in five columns 30, is housed between a front plate 2 and a rear member 3, which rests firmly in a base located in a tail section 20, thus withstanding the acceleration of the packet of submunitions at the moment of firing. The rear member 3 is cylindrical in shape with circular holes 102 through which submunition thrust cones 4 can be inserted and an axial bore 110 which receives the upper end of a rod 10. Member 3 additionally includes vertical bore holes 112 and 114.

A spring-mounting vessel 6, is fitted between the rear member 3 and the tail 20 by means of a rod 10 held in position by bushes 8 and 9. Spring-mounting vessel 6 is fastened inside tail 20 by threaded bushing 9. An ejection spring 7 is contained inside vessel 6, and extends between the bottom of the vessel 6 and a floating pusher disc 5 to which five pusher cones 4 are attached.

Fixed to this disc 5 are parts shaped either like a cone or as necessary to house the fuses of the lower submunition floor, with its larger outlet being able to slide along the cylindrical housing situated on the rear member 3.

The entire submunition packet is housed between the front plate 2 and rear member 3 by means of long rods 12 which have upper ends extending through openings 115 in and aligned openings in front plate 2. Nuts 16 on the upper ends of rods 12 clamp bell 1. Rods 12 also extend through openings 116 in pusher disc 5. The lower end of each rod 12 is connected to a shear pin 11 beneath the lip of vessel 6. Spring 7 is compressed by part 5 which is held in position by rods 12.

Assembly of the shell as a whole is completed by joining the bell 1 to the warhead 18 by means of screws 17, the body 19 to the tail 20 by means of shear pins 21, and the vessel 6 to the tail 20 by means of the rod 10 and parts 8 and 9, thus making the shell ready for use. The rod 12 fix the head by means of nuts 16 to bell part 1, which in turn retains warhead 18 by means of screws.

The unit basically works as follows:

Explosive such as gunpowder 15 contained in the bell 1 attached to the warhead is detonated by means of a delayed fuse of any of the types in common use for this function. The expansion of the gases which occurs when the powder 15 is detonated produces pressure between the inside of the nose cone 18 and the plate 2, which pulls on the body 19 and causes it to separate from the tail 20 by shearing pins 21. The detonation also shears pins 11 to release the lower ends of rods 12.

The warhead 18 and the housing 19 are driven forwardly in the flight direction of the projectile, becoming completely detached from the other components, at which time the excess pressure of the gases from the explosion of powder 15 is discharged into the atmosphere and its effect ceases.

When the pressure of the gases ceases on the plate 2, with the rods 12 having sheared as indicated above, the spring 7 pushes the floating disc 5 and cones 4 forward until disc 5 hits the rear member 3 which is attached to the tail 20 by means of the rod 10. The movement of the cones 4 pushes the submunitions forward, and releases them from their housing on the rear plate 3, leaving them exposed to the action of the wind, which activates the stabilizing mechanism of the submunitions, such as, for instance a parachute or any other means having a similar function.

The forward movement of the cones would not be sufficient to expel the submunitions without the removal of the first part or cap 104 of the first submunition which exerts pressure on plate 2.

After housing 19 clears the underlining assembly, spring 14 urges radial pin 13 and its downwardly extending pin 103 outwardly to expel the cap of the uppermost submunition into the air stream. The submunition there beneath are also expelled outwardly.

Thus, at the same time as the submunitions are thrust forward until they are freed from their housing on member 3, the springs 14 located in appropriate housings on the plate 2 are no longer being compressed by the body 19, expand outwardly, dragging the submunitions from the upper floor, by means of cogs 13, thus creating a lateral component which facilitates the separation of the submunition columns and improves their dispersion when falling over the ground.

Just as the submunitions from the lower floor are braked by the action of their stabilization system, submunitions are removed from the following floor, and these, in turn, expose their stabilization systems to the wind, reproducing the effect previously described, until the submunitions contained in the projectile are completely separated.

From this moment on the submunitions fall in free stabilized flight until they reach the ground or targets located in their zone of action.

I claim:

1. A projectile including a housing including forward housing portion having a forward end and a tail portion on a rear end portion of the housing, a pusher disc in the rear end portion of the housing, bell means mounted in the forward housing portion, a front plate immediately to the rear of said bell means, a submunition ejection system comprising stacked submunitions arranged in columns extending lengthwise of the housing between a location adjacent the bell means in the forward end of the housing and said rear plate, spring mounting means in the rear end portion of the housing, a plurality of rods each having a shear section and a forward end connected to the bell means and a rear end connected to the spring mounting means near the rear end of the housing, forward force exerting spring means in the spring mounting means for urging the submunitions forwardly toward and against the front plate which is itself prevented from forward movement by said bell means which is prevented from forward movement by said rods, explosive means for shearing the rods and separating the forward portion of the housing from the tail portion, outward force exerting spring means for shifting the forwardmost submunition outwardly after separation of the forward housing portion from the tail portion so that said forward force exerting spring means can move the remaining submunitions forwardly for subsequent discharge in like manner from the projectile.

2. A projectile as recited in claim 1 wherein said outward force exerting spring means exerts an outward face on radial pin means mounted in said front plate and having a pusher pin engageable with cup means on the most forwardly positioned submunition.

* * * * *